US005382110A

United States Patent [19]

Perotto et al.

[11] Patent Number: 5,382,110

[45] Date of Patent: Jan. 17, 1995

[54] QUICK COUPLING DEVICE

[75] Inventors: Richard D. Perotto, Beaverton; Terry L. Briscoe, Portland; Christopher M. Carpenter, Tualatin; Dean F. Richards, Hillsboro, all of Oreg.

[73] Assignee: ESCO Corporation, Portland, Oreg.

[21] Appl. No.: 998,671

[22] Filed: Dec. 30, 1992

[51] Int. Cl.[6] ..... F02F 3/413

[52] U.S. Cl. ..... 403/322; 172/272; 414/723; 414/724

[58] Field of Search ..... 414/723, 724, 686; 172/272, 275; 403/322

[56] References Cited

U.S. PATENT DOCUMENTS

| | | | |
|---|---|---|---|
| 2,304,282 | 12/1942 | Ross . | |
| 2,447,150 | 8/1948 | Andersen . | |
| 2,468,683 | 4/1949 | Michal . | |
| 2,524,083 | 10/1950 | Ronning | 56/10 |
| 2,691,452 | 10/1954 | Wells, Jr. et al. | 414/723 |
| 2,963,183 | 12/1960 | Przybylski | 214/145 |
| 3,034,237 | 5/1962 | Wolfe et al. | 37/117.5 |
| 3,075,661 | 1/1963 | Knutson | 214/140 |
| 3,233,350 | 2/1966 | Malzahn et al. | 37/144 |
| 3,237,795 | 3/1966 | Kromer | 214/140 |
| 3,269,570 | 8/1966 | Wallberg | 214/131 |
| 3,389,819 | 6/1968 | Schumacher | 214/780 |
| 3,403,802 | 10/1968 | Lundell | 214/778 |
| 3,512,665 | 5/1970 | Westendorf | 214/145 |
| 3,556,323 | 1/1971 | Heimmermann | 214/145 |
| 3,583,589 | 6/1971 | Leijon | 37/117.5 X |

(List continued on next page.)

FOREIGN PATENT DOCUMENTS

| | | |
|---|---|---|
| 0278571 | 10/1990 | European Pat. Off. . |
| 1408271 | 12/1965 | France . |
| 2511819 | 9/1976 | Germany . |
| 106518 | 6/1965 | Norway . |
| 200291 | 7/1923 | United Kingdom . |
| 262548 | 5/1970 | U.S.S.R. . |

OTHER PUBLICATIONS

Wimmer * Hartstahl * Quick-Lock Advertisement.

Svets Maskin Produkter, Swing-o-Plan Rotator Brochure.

French Advertisement, Mecalac II CX.

Viby Jern Danmark A/S Brochures and Price Lists.

Weldco-Beales Advertisement.

Universal Backhoe Quick Coupler Advertisement, "World's No. 1 Universal Loader-Excavator Quick Coupler".

Geith Quick Hitch Attachment Advertisement, p. 28.

Central Fabricators, Inc. Quick-Latch Advertisement.

Caterpillar's CAT's Versa-Link System for Caterpillar Excavators Advertisement.

Wain-Roy®, Quick Change Coupler Mounting System Advertisement.

Hydraulic "ajusta-buckets" Advertisement.

Werk-Brau Co., Inc., Multi-product Advertisement.

Wain-Roy®, Inc., Quick Change Toolhitch System Advertisement.

Bofors, Quick Hitches for Excavators and Backhoe Loaders Advertisement.

Werk-Brau Co., Inc., E-Z Tilt Advertisement.

Case, Product News, Excavators, Jun. 1983.

Bofors, Quick Hitch for Hydraulic Excavators, Operating and Maintenance Instructions.

*Primary Examiner*—Randolph A. Reese

*Assistant Examiner*—Christopher J. Novosad

*Attorney, Agent, or Firm*—Banner, Birch, McKie and Beckett

[57] ABSTRACT

A quick coupling device adapted for mounting a tool to a boom of a carrier includes a coupling structure defining at least one notch and a cam assembly. The cam assembly includes a channel having an open end and a seating wall. The cam assembly is rotatable between an open position and a closed position to facilitate installation, locking and release of the tool from the boom. To lock the tool to the boom, the cam assembly is rotated until the seating wall engages a tool mounting pin received in the channel to effect a firm gripping of the pins.

24 Claims, 5 Drawing Sheets

U.S. PATENT DOCUMENTS

| | | | |
|---|---|---|---|
| 3,606,052 | 9/1971 | Schurz | 214/145 |
| 3,672,521 | 6/1972 | Bauer et al. | 214/145 |
| 3,705,656 | 12/1972 | Hunger et al. | 214/145 |
| 3,718,222 | 2/1973 | Foster | 214/145 |
| 3,760,883 | 9/1973 | Birk | 172/273 |
| 3,794,195 | 2/1974 | Clevenger et al. | 214/145 |
| 3,807,769 | 4/1974 | Thompson et al. | 280/479 R |
| 3,818,551 | 6/1974 | Coughran, Jr. | 214/145 X |
| 3,874,533 | 4/1975 | Montgomery | 214/145 |
| 3,887,096 | 6/1975 | Wieland | 214/145 |
| 3,934,738 | 1/1976 | Arnold | 214/145 A |
| 3,964,622 | 6/1976 | Blair et al. | 214/145 A |
| 3,985,249 | 10/1976 | Aker et al. | 214/145 A |
| 4,056,250 | 11/1977 | Uchiyama | 248/14 |
| 4,067,467 | 1/1978 | Datta et al. | 214/145 A |
| 4,085,856 | 4/1978 | Westendorf | 214/145 A |
| 4,116,346 | 9/1978 | Uchida | 214/145 A |
| 4,116,347 | 9/1978 | Uchida | 214/145 A |
| 4,127,203 | 11/1978 | Arnold | 214/145 A |
| 4,133,121 | 1/1979 | Hemphill | 37/118 R |
| 4,136,792 | 1/1979 | Wilson | 214/145 A |
| 4,146,642 | 3/1979 | Myers | 414/719 |
| 4,187,050 | 2/1980 | Barbee | 414/723 |
| 4,208,163 | 6/1980 | Holmqvist | 414/723 |
| 4,213,731 | 7/1980 | Verachtert | 414/723 |
| 4,214,840 | 7/1980 | Beales | 403/31 |
| 4,243,356 | 1/1981 | Takojima | 414/723 |
| 4,251,181 | 2/1981 | Drott et al. | 414/723 |
| 4,253,793 | 3/1981 | Braml | 414/723 |
| 4,295,287 | 10/1981 | Natzke et al. | 414/723 X |
| 4,355,945 | 10/1982 | Pilch | 414/723 X |
| 4,417,844 | 11/1983 | de Pingon | 414/723 |
| 4,452,560 | 6/1984 | Coyle et al. | 414/723 |
| 4,454,665 | 6/1984 | Mannbro | 37/103 |
| 4,545,720 | 10/1985 | Cochran et al. | 414/723 |
| 4,810,162 | 3/1989 | Foster | 414/723 |
| 4,824,319 | 4/1989 | Arnold | 414/723 |
| 4,850,790 | 7/1989 | Johnson et al. | 414/723 |
| 4,890,974 | 1/1990 | Kistner | 414/723 |
| 4,938,651 | 7/1990 | Gilmor et al. | 414/694 |
| 5,082,389 | 1/1992 | Balemi | 414/723 X |
| 5,108,252 | 4/1992 | Gilmore, Jr. et al. | 414/694 |
| 5,147,173 | 9/1992 | Fauber et al. | 414/723 |
| 5,199,844 | 4/1993 | Gilmoke, Jr. et al. | 414/723 X |

QUICK COUPLING DEVICE

FIELD OF THE INVENTION

The present invention pertains to a quick coupling device for attaching mining and construction tools, such as buckets, impact hammers, etc., to a boom of a carrier.

BACKGROUND OF THE INVENTION

In a mining or construction operation, many different tools are ordinarily needed to complete the project. For example, there may arise a need for using a different sized bucket or exchanging a bucket for an impact hammer. To minimize the number of carriers at a job site, a single carrier is often used to support and operate a number of different tools. In the present application, only the use of a backhoe is discussed for the purposes of illustration. Nevertheless, other carriers are also used in similar ways.

A typical backhoe comprises a moveable vehicular portion and an elongated, articulated boom. The boom is comprised of a number of pivotally interconnected arms moved and controlled by a series of hydraulic cylinders. The arm defining the free end of the boom is commonly referred to as the stick. The stick defines a transverse bore on its free end for receiving a mounting pin. The mounting pin is further received through corresponding holes in the tool to pivotally secure the tool to the stick.

A box end linkage is also typically provided along the free end to support and move the tool as desired. Specifically, a box end linkage is comprised of a pair of articulated links, wherein one of the links is pivotally attached to the stick, one of the links is pivotally attached to the tool, and the two links are pivotally attached to each other. A hydraulic cylinder is pivotally coupled to the links at the point of their interconnection with each other. As the hydraulic cylinder is expanded and retracted, the tool is rotated about the mounting pin connecting the tool to the stick. Alternatively, the hydraulic cylinder is at times attached directly to the tool, thus omitting the box end linkage. While the operation of the tool is substantially the same in this alternative construction, the range of pivotal movement and curling force are significantly reduced.

To accommodate the mounting of the tools to the boom, all of the tools are generally provided with a common mounting arrangement. Ordinarily each of the tools are provided with a pair of upstanding flanges spaced apart to define a gap into which is received the ends of the stick and the linkage. The flanges are each provided with a pair of spaced apart bores for receiving the tool mounting pins. Although the use of two mounting pins is common, more than two could also be used. As can be appreciated, alignment and installation of the mounting pins in the field is an onerous and time consuming task. Moreover, due to the tight fit of the pins, their removal can also be difficult to achieve.

In view of the need to interchange tools on a carrier, many quick coupling devices have been developed to ease and speed the installation and removal of the tools in the field. In general, most of the quick coupling devices are designed to quickly and easily engage and attach to the mounting pins which extend across the upper portion of the tools. Although many different constructions have been developed, a common quick coupling device includes notches adapted to receive one of the mounting pins and a second mechanism adapted to receive and secure the other of the mounting pins. With this arrangement, the tools are securely locked to the quick coupling device. Examples of this type of construction are shown in U.S. Pat. Nos. 4,810,162 to Foster, 4,355,945 to Pilch, 4,295,287 to Natzke et al. and 4,187,050 to Barbee.

The quick coupling devices of the prior art have reduced the time and effort otherwise needed to exchange tools on a carrier. Nevertheless, the quick coupling devices of the prior art are designed to engage only those tools having mounting pins which are spaced apart a specific distance. Unfortunately, in practice, all tools do not have a uniform spacing between the mounting pins. In such cases, the operator is forced to either not use the quick coupling device in regard to these tools or have additional quick coupling devices available to accommodate pins of different spacings.

Additionally, due to the affects of wearing and differences in manufacturing tolerances, the quick coupling devices often loosely grip the tool to be operated. Such looseness in the connection not only causes the tool to suffer premature wearing, but also increases the risk of an unintended release of the tool. As can be appreciated, this can create a very dangerous situation for the workmen involved. In regard to certain tools, such as an impact hammer, the looseness in the connection can also hamper the ability of the operator to properly position the tool.

SUMMARY OF THE INVENTION

The present invention pertains to a quick coupling device having the versatility to accommodate variations in spacing between the mounting pins in different tools. The present invention further ensures that the pins are secured in a tight gripping manner, irrespective of the affects of wearing or tolerance differences, and alleviates the risk of an unintended release of the tool. Moreover, despite these advantages of the present invention over the prior art, the ability to easily and quickly exchange tools is not sacrificed.

The quick coupling device of the present invention includes the cooperative use of at least one notch and a cam assembly to receive and seat the mounting pins of the tool to be supported and used. The cam assembly includes a channel which is open on one end and defines a seating wall for effecting firm gripping of the mounting pins. The cam assembly rotates between an open position and a locked position to facilitate coupling and release of the tool to the device. In the open position, the tool mounting pins can be easily slid into the at least one notch and the channel of the cam assembly. To lock the tool to the quick coupling device, the cam assembly is rotated until the seating wall engages the pin in the channel and effects a firm gripping of the tool.

In the preferred construction, the quick coupling device is comprised of a pair of flanges defining two sets of notches for receiving the two tool mounting pins. The cam assembly is mounted between the flanges adjacent one set of notches. In the open position, the channel of the cam assembly opens concurrently with the adjacent set of notches. In this construction, the relevant tool mounting pin is received within both the channel and adjacent set of notches. In the locked position, a portion of the cam assembly closes the adjacent notches to thereby retain the seated tool mounting pins in the notches. The cam assembly is preferably rotated by a worm gear mechanism to provide infinite adjustment and to securely lock the assembly to prevent an unintended release of the tool.

DETAILED DESCRIPTION OF THE PREFERRED EMBODIMENT

Figure 2:
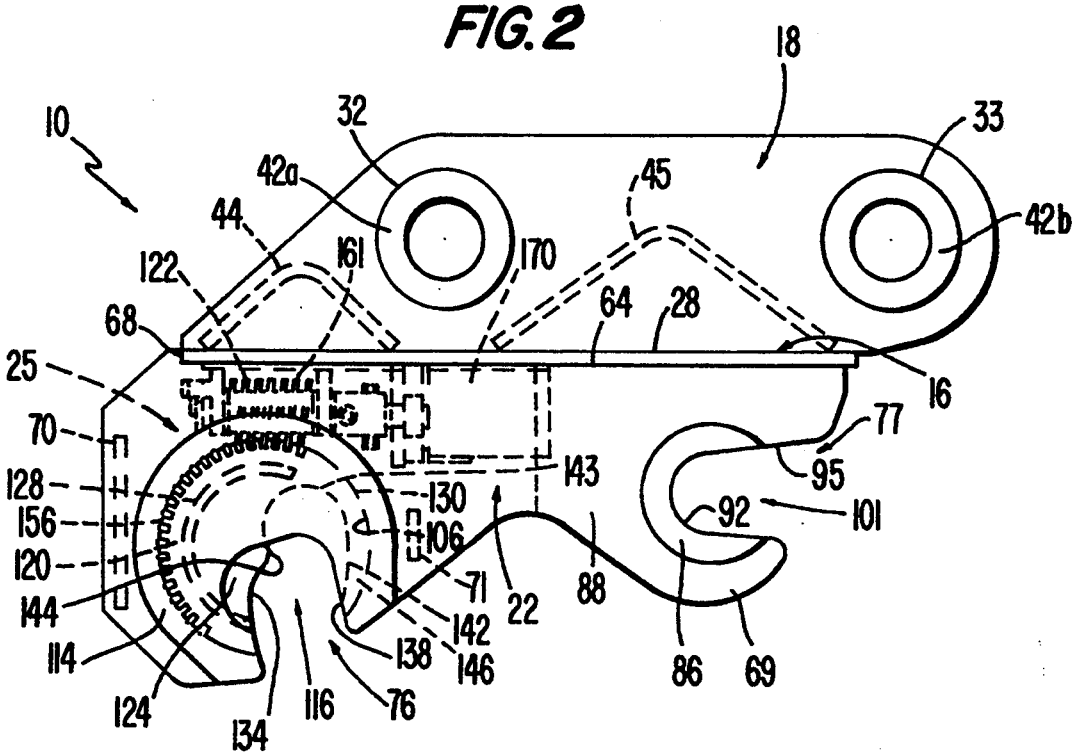
FIG. 2 is a side elevational view of the present invention.
Figure 3:
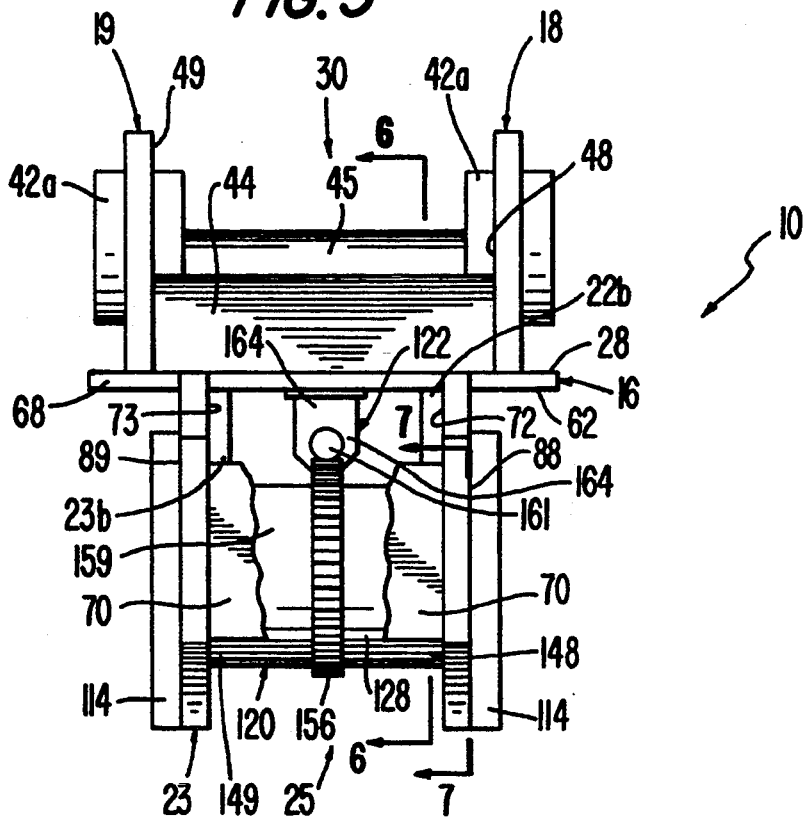
FIG. 3 is a rear elevational view of the present invention with the safety latch omitted for clarity.

The present invention pertains to a quick coupling device 10 for attaching mining and construction tools to a boom 12 of a carrier. Although the present invention may be adapted for use with a wide variety of carriers and tools, for illustration purposes the following description is directed to the use of the present quick coupling device to attach a bucket 14 to a boom 12 of a backhoe. As can be appreciated, operation of the boom will cause the present device to assume many different orientations. Nevertheless, for purposes of explanation, the elements of device 10 are at times described in regard to relative directions such as up and down. These directions should be understood with respect to the orientation of the device as shown in FIG. 2, unless stated otherwise.

Figure 1:
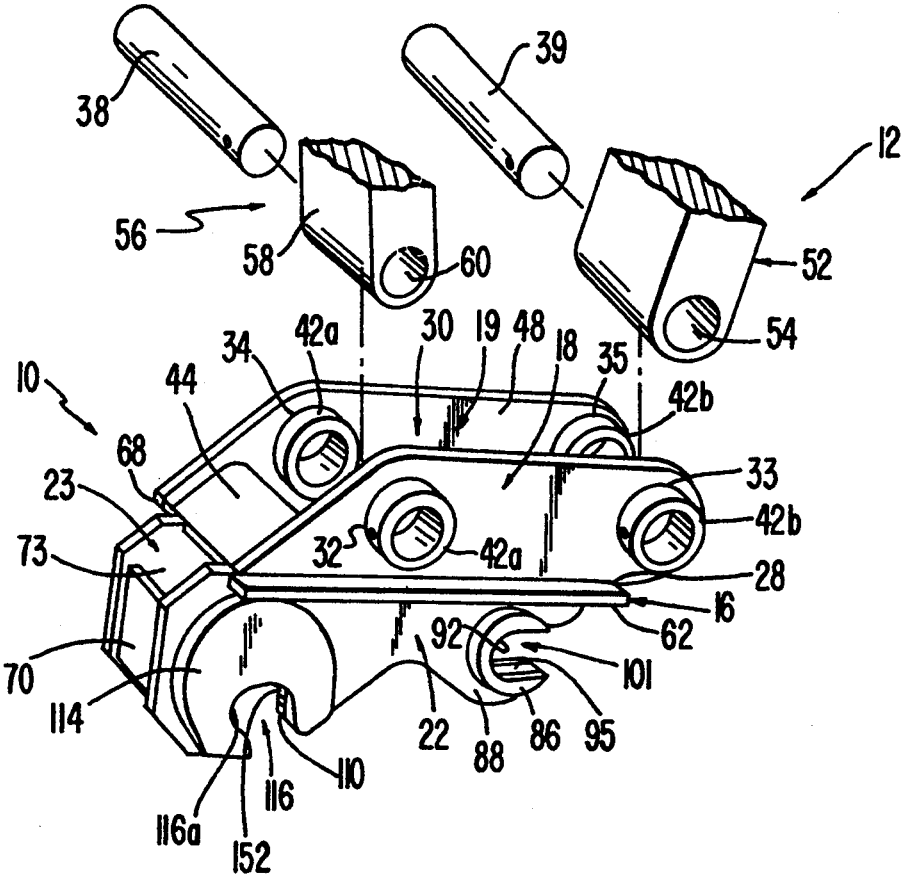
FIG. 1 is an exploded, perspective view of the present invention mounted to the end of a boom of a carrier.
Figure 5:
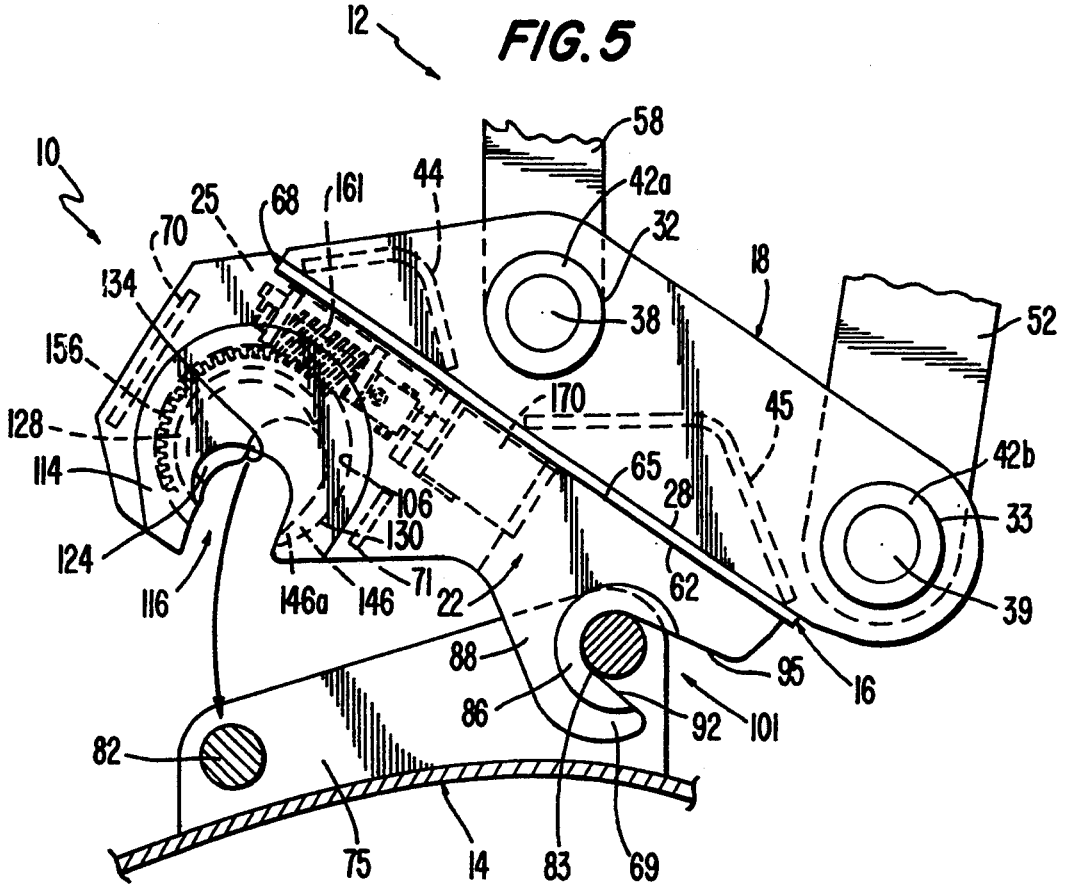
FIG. 5 is a side view of the present invention in the process of being attached to a tool.
Figure 6:
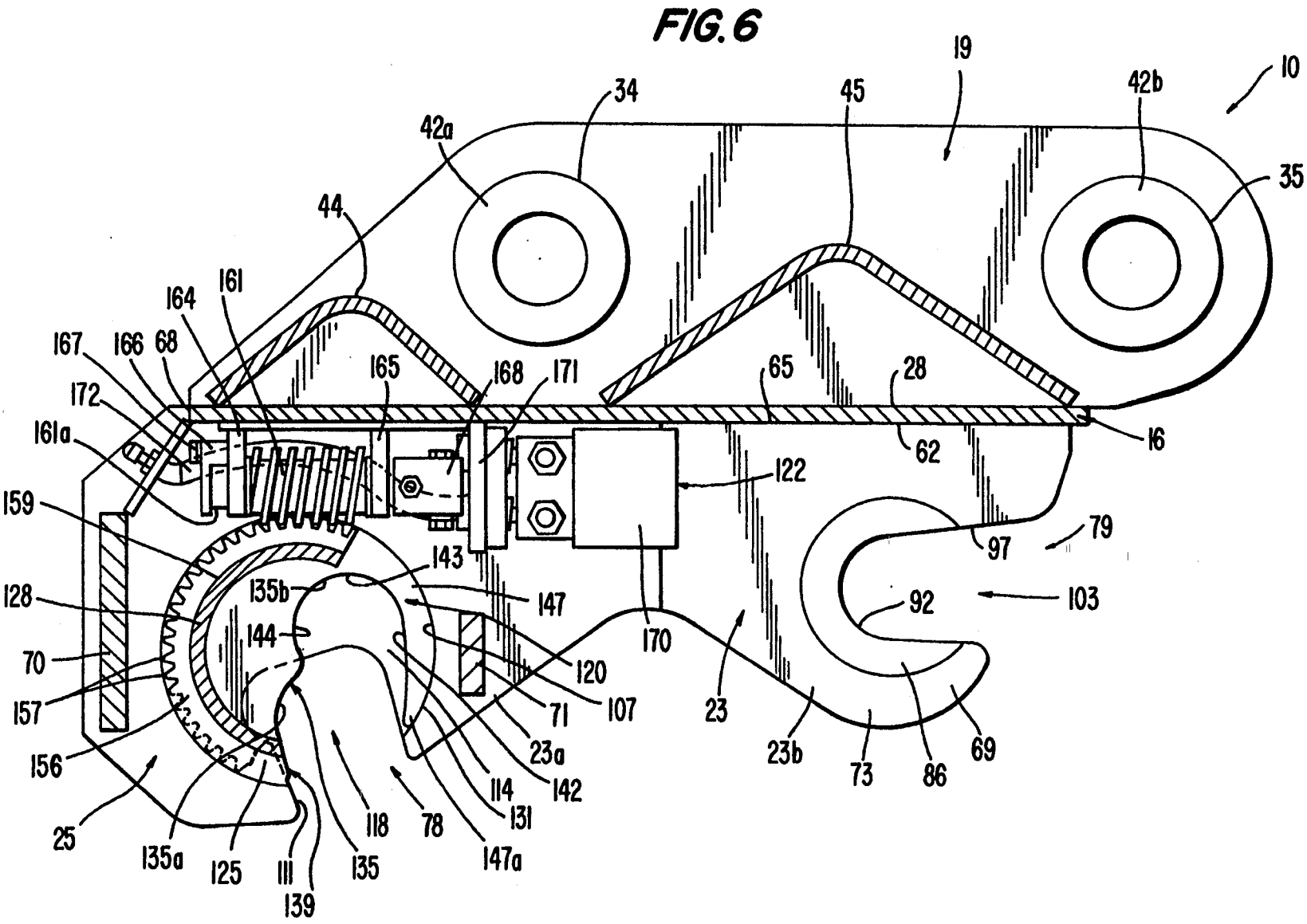
FIG. 6 is a cross sectional view taken along line 6—6 in FIG. 3.
Figure 9:
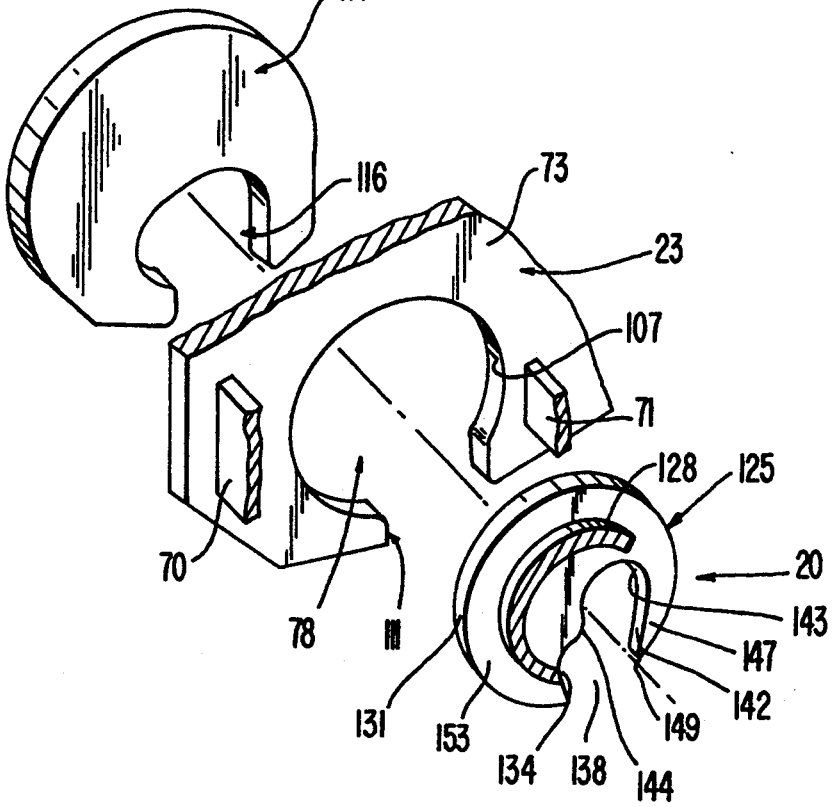
FIG. 9 is an exploded, fragmentary perspective view of the cam assembly mounted in the coupling flanges of the present invention.

In the preferred embodiment, quick coupling device 10 includes a base plate 16, a pair of upstanding mounting flanges 18, 19 a pair of downwardly projecting coupling flanges 22, 23 and a cam mechanism 25. Mounting flanges 18, 19 are provided to movably attach device 10 to boom 12 of a backhoe or other carrier (FIGS. 1 and 5). Coupling flanges 22, 23 are provided to releasably secure bucket 14 or other tool to device 10 with the cooperation of cam mechanism 25 (FIGS. 5 and 6).

Mounting flanges 18, 19 are formed of plate members which project upward from upper face 28 of base plate 16 (FIGS. 1–5 and 7). Flanges 18, 19 are preferably welded to base plate 16, although the structure could be formed by other means, such as casting or forging processes. Mounting flanges 18, 19 are spaced apart and generally parallel with each other to define a gap 30 for receiving the end of boom 12. Bores 32–35 are defined in flanges 18, 19 to facilitate mounting of device 10 to boom 12. Specifically, each flange 18, 19 includes a rear bore 32, 34 and a front bore 33, 35. Rear bores 32, 34 are aligned with each other to receive mounting pin 38, whereas front bores are aligned to receive mounting pin 39. Annular bosses **42*a*, 42*b* are mounted within each bore 32–35 to prevent premature wearing of flanges 18, 19. Alternatively, a pair of bosses could be mounted along the sides of each bore 32–35 instead of the through bosses 42*a*, 42*b*. Additionally, angular braces 44, 45 extend between flanges 18, 19 to provide enhanced support. Braces 44, 45 in the preferred construction each has a generally inverted V-shaped configuration with its ends fixed by welding to the inner faces 48, 49 of flanges 18, 19**. Of course, braces of other shapes and fixed by other means could be used.

In a backhoe, the boom 12 is typically comprised of a series of articulated arms movably controlled by a plurality of hydraulic cylinders. The distal arm is commonly referred to as the stick 52 (FIGS. 1 and 5). The free end of stick 52 is matingly received between bosses **42*b* and includes a transverse bore 54 in alignment with front bores 33, 35. Mounting pin 39 is received through the aligned bores 33, 3.5, 54 to pivotally couple device 10 to stick 52. Pin 39** is secured in the bores through the use of a transverse locking pin (not shown) or other conventional means.

A box end linkage 56 is usually mounted near the free end of stick 52 to additionally support device 10. The end hydraulic cylinder (not shown) is coupled to box end linkage 56 to enable a controlled pivotal movement of device 10 about pin 39. A box end linkage generally includes two pivotally connected links which interact with the end hydraulic cylinder to rotate device 10 about pin 39. One link (not shown) is pivotally attached to stick 52 near its free end, while the other link 58 is secured to quick coupling device 10. Specifically, the distal end of link 58 is matingly received between bearings **42*a* and includes a transverse bore 60 in alignment rear bores 32, 34. Mounting pin 38 extends through bores 32, 34 and bore 60 to movably attach device 10 to link 58. As with pin 39, mounting pin 38 is secured in the bores by a transverse locking pin (not shown) or other conventional means. If the box end linkage is omitted, the end hydraulic cylinder is attached directly to device 10. However, in such cases, the range of pivotal movement and curling force for bucket 14** are reduced.

Figure 4:
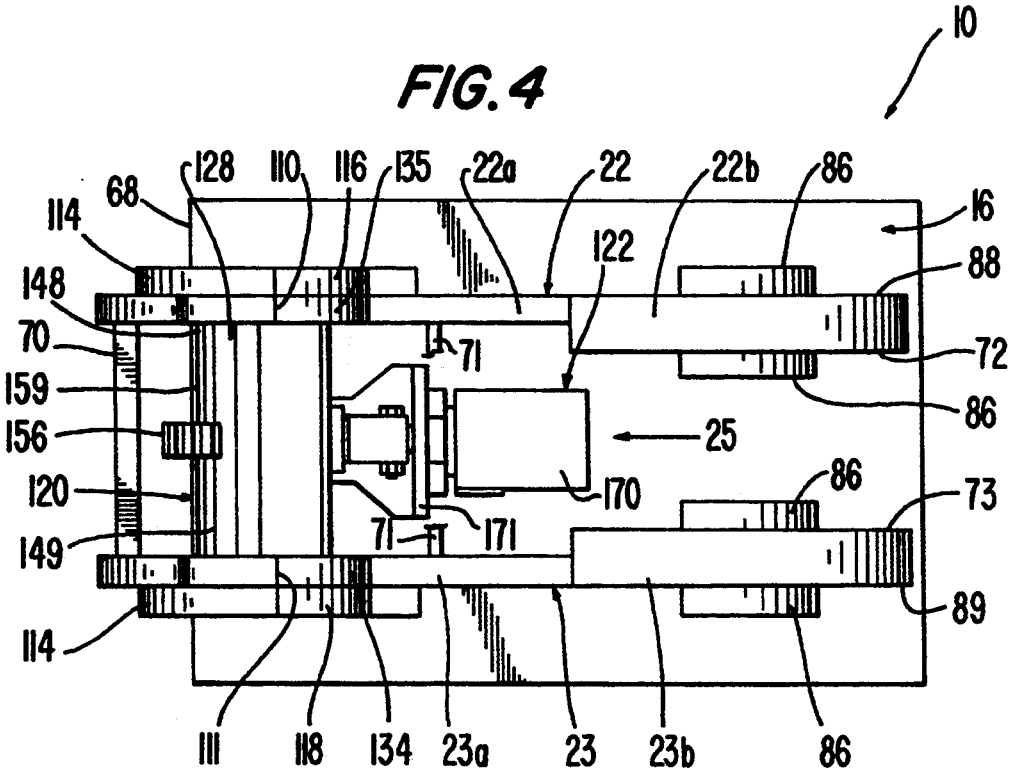
FIG. 4 is a bottom plan view of the present invention.

Coupling flanges 22, 23 are each formed as a plate member which projects downward from lower face 62 of base plate 16 (FIGS. 1–5 and 7). In particular, the upper edges 64 65 of flanges 22, 23 lie flush against lower face 62 and rear edge 68 of base plate 16. Flanges 22, 23 are preferably welded to base plate 16, but could be formed by another process, such as casting or forging. In the preferred construction, flanges 22, 23 are each formed of two plate segments **22*a*, 22*b*, 23*a*, 23*b* (FIG. 4). Front segments 22*b*, 23*b* are thicker than rear segments 22*a*, 23*a* for increased section modulus in bending of front lower portion of flanges 22, 23. The increased strength alleviates the risk of bending the arm sections 69 of flanges 22, 23 under load. Rear segments 22*a*, 23*a* are additionally preferably supported by a rear plate 70 and inner brace 71 fixed between the inner sides 72, 73 of flanges 22, 23 (FIGS. 2 and 5–7). Additional supporting braces could be used as needed. Also, while coupling flanges 22, 23 are preferably formed as parallel flanges with thickened ends, they could be formed in many different ways such as in a non-parallel relationship or as angular flanges with one or more medial jogs. In the preferred construction, coupling flanges 22, 23 are adapted to be received within mounting flanges 75** of the tool (FIG. 5).

Coupling flanges 22, 23 are each further configured to define a rear opening 76, 78 and a front opening 77, 79 (FIGS. 1–2, 5–6 and 7). Rear openings 76,78 are aligned with each other to receive therein a portion of cam mechanism 25 and one of the tool mounting pins 82. Front openings are also aligned with each other to receive therein the other tool mounting pin 83. As discussed below, openings 76–79 and cam mechanism 25 function to releasably lock the tool to device 10.

Front openings 77, 79 each has a general U-shape configuration which opens in a forward direction (FIGS. 1–5 and 7). Bosses 86 are affixed to the inner and outer sides 72, 73, 88, 89 of flanges 22, 23. Bosses 86 could also be in the form of through bosses. Bosses 86 have a generally C-shaped configuration which includes an inner concave edge surface 92. Edge surfaces 92 of bosses 86 are aligned with the concave edge surfaces 95, 97 of the flange portions defining front openings 77, 79. Bosses 86 and flanges 22, 23 thus cooperatively define front notches 101, 103 to seat tool mounting pin 83. As can be appreciated, the addition of bosses 86 greatly increases the surface area supporting the loads generated through tool pin 83. The resultant pressure on flanges 22, 23 is thereby reduced which, in turn, lessens the rate at which flanges 22, 23 and pin 83 wear.

Rear openings 76, 78 each has a relatively large circular portion defined by a curved edge face 106, 107 and a short linear portion 110, 111 which opens downwardly in flanges 22, 23. Linear portions 110, 111 have a width significantly less than the arcular portion defined by edge faces 106, 107 (FIGS. 2, 5–7 and 9). With this construction openings 76, 78 open in a generally downward direction to receive tool pin 82 therein. Rear bosses 114 are affixed to the outer sides 88, 89 of flanges 22, 23 around the periphery of openings 76, 78. Bosses 114 each include a lower notch 116, 118 adapted to receive and seat tool pin 82. Notches 116, 118 are generally U-shaped except for bulged portions **116*a*, 118*a* in the rearward portions thereof. Notches 116, 118 are aligned with and preferably have the same width as linear portions 110, 111 of openings 76, 78. The width of notches 116, 118 is formed to be considerably greater than the diameter of the tool mounting pins 82, 83 to accommodate tool mounting pins having different spacings. With this construction, tool pin 82 can be received into and seated in rear notches 116, 118. The remainder of openings 76, 78 not aligned with notches 116, 118 are covered by bosses 114**.

Cam mechanism 25 is mounted between coupling flanges 22, 23 to cooperate with notches 101, 103, 116, 118 in coupling and releasing bucket 14 to device 10 (FIGS. 2–9). In particular, cam mechanism 25 is comprised of a cam member 120 and a drive assembly 122. In the preferred construction, cam member 120 includes a pair of end disks 124, 125 interconnected by a medial body 128, although other constructions could be used. Each end disk 124, 125 is a circular planar member which is matingly received in the circular portion of openings 76, 78. The outer rims 130, 131 of disks 124, 125 are engaged with and move along edge faces 106, 107 when cam member 120 is rotated.

End disks 124,125 further include slots 134, 135 aligned with each other to define a channel for receiving a mounting pin therethrough. Each slot 134, 135 opens along the outer edge to form a gap 138, 139 in rim 130, 131. Gaps 138, 139 have generally the same width as linear portions 110, 111 of openings 76, 78 and notches 116, 118 of bosses 114. Slots 134, 135 are each defined by a broad generally uniform curved front wall 142, a more tightly curved end seating wall 143, and a contoured rear wall 144 having a broad W-shaped configuration (FIGS. 2 and 5–9). Walls 142–144 cooperatively define slots 134, 135 each into two slot portions **134*a*, 134*b*, 135*a*, 135*b*. Slots 134, 135 are formed off-center in the lower portion of disks 124, 125 to define the channel with a non-radial configuration and to provide the desired camming effect described more fully below. The lower portion of disks 124, 125 between slots 134, 135 and rims 130, 131 include a finger 146, 147 which tapers to a point 146*a*, 147*a* at gap 138, 139. As discussed below, the tapered free end ensures passage of the finger under the received tool mounting pin 82 to close notches 116, 118 and lock the tool to device 10**.

Body 128 has a thin arcuate configuration preferably defining a section of a cylinder. The ends 148, 149 of body 128 are, in the preferred construction, welded to the inner faces 152, 153 of end disks 124, 125. Body 128 has a C-shaped configuration which extends from the rear wall 144 at gap 138, 139 and around to seating wall 143. This construction not only provides ample strength with minimal weight, but also provides sufficient clearance for receipt of tool pin 82 in slots 134, 135. An arcuate rack 156 having a series of radially extending teeth 157 is mounted centrally along the outer surface 159 of body 128.

Drive assembly 122 interacts with rack 156 to rotate cam member 120 between open and locked positions. More specifically, drive assembly 122 includes a worm 161 enmeshed with the teeth of worm gear 156. Worm 161 is rotatably mounted between a pair of bearings 164, 165 fixed to lower face 62 of base plate 16. Worms and worm gears have a self-locking capability when the worm lead angles are shallow (e.g., on the order of 5° or less). Of course, if greater actuation speed is desired, (e.g., in a manually activated device) the lead angles could be increased. Hence, the use of the worm gear in combination with the containment of the tool mounting pin within bosses 114 and cam member 120 minimizes the risk of an unintended release.

Figure 10:
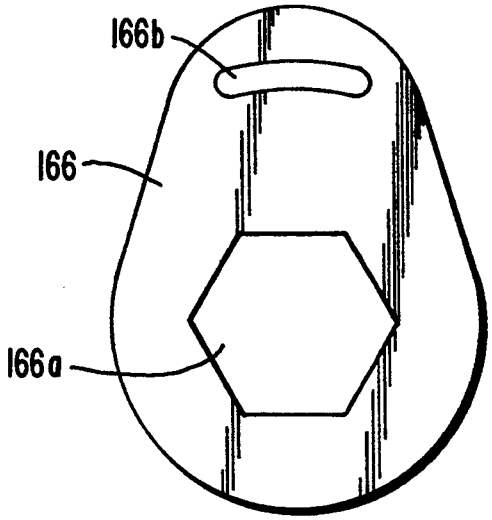
FIG. 10 is a front elevational view of the safety latch of the present invention.

On manually operated units, an assembly for locking worm 161 against unintended rotation is desirable for safety purposes. As an example, safety latch 166 is mounted adjacent an end **161*a* of worm 161 (FIGS. 6 and 10). Safety latch 166 includes a hex opening 166*a* for matingly receiving end 161*a* of worm 161 for positively locking the worm in place. Safety latch 166 is moved toward and away from worm 161 by bolt 167. To ease receipt of latch 166 over end 161*a*, bolt 167 is received through an arcuate slot 166*b***.

In the preferred construction, worm 161 is connected on one end to the drive shaft 168 of hydraulic motor 170 (FIGS. 2, 5 and 6). Motor 170 is attached to the underside of base plate 16 by one or more brackets 171. Hoses 172 (only one of which is shown) convey the oil to and from motor 170 (FIG. 6). The controls (not shown) for motor 170 are preferably in the cab within reach of the operator.

Additionally, the cam member can be intermittently rotated during use to maintain a tight grip on the tool mounting pins to prevent looseness from developing due to vibration or wearing. This intermittent actuation may be accomplished in a number of different ways. For example, the intermittent tightening of cam member 120 can be controlled by a timer or a sensor which is activated by movement of the boom. Also, other types of motors or a manual drive may be used. In a manual drive arrangement, the worm would include a drive shaft and a nut accessible from the rear of device 10.

Figure 7:
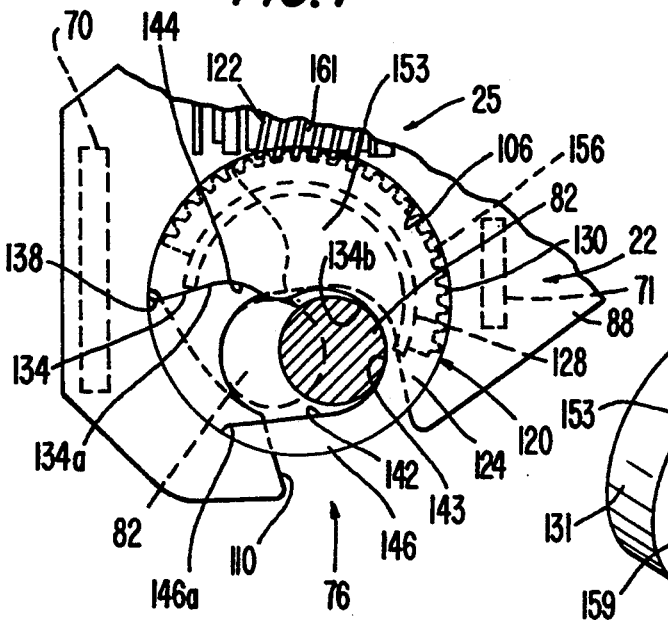
FIG. 7 is an enlarged, fragmentary cross sectional view along line 7—7 in FIG. 3 of the cam assembly in a locked position with one of the mounting pins, with an alternative locked position being shown in phantom.
Figure 8:
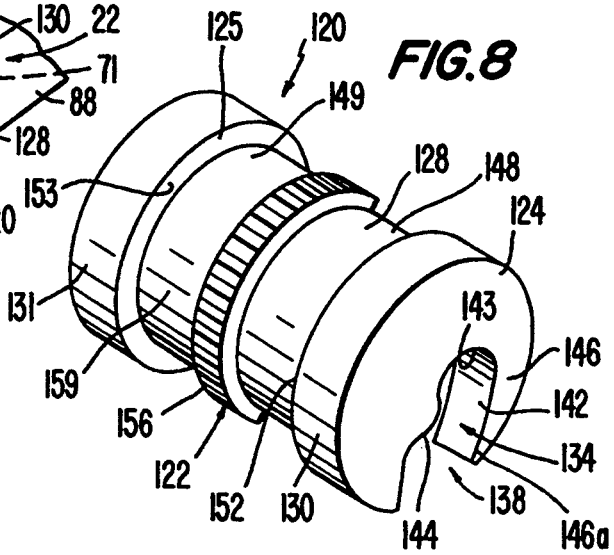
FIG. 8 is a perspective view of the cam member of the present invention.

To install bucket 14 on device 10 cam member 120 is rotated by drive assembly 122 to its release or open position (FIGS. 1–2, 5 and 6). At this point, slots 134, 135 are aligned with notches 116, 118; that is, gaps 138, 139 defined by slots 134, 135 are aligned with linear portions 110, 111 of openings 76, 78 and notches 116, 118 of bosses 114. As a first step, device 10 is rotated by a hydraulic cylinder (not shown) about mounting pin 39 so that it is inclined upward at about an angle of about 45° (FIG. 5), although many other angles of inclination would certainly work. Quick coupling device 10 is then lowered downwardly along a generally arcuate path toward tool pin 83, so that pin 83 is received and seated in front notches 101, 103. Once pin 83 is seated, device 10 is pivoted downwardly about pin 83, until tool pin 82 is received into notches 116, 118. At this point, pin 82 lies in the first slot portions 134*a*, 135*a* of slots 134, 135 of cam member 120. The operator then actuates motor 170 to turn worm 161. As can be appreciated, the rotation of worm 161 causes the worm gear 156, and hence cam member 120, to rotate clockwise (as seen in FIGS. 2, 5–7). As end disks 124, 125 rotate, fingers 146, 147 are passed under pin 82 (FIG. 7). The pointed free ends 146*a*, 147*a* ease the passage of fingers 146, 147 under tool pin 82. During the rotation of cam member 120, pin 82 remains in notches 116, 118 and travels along the channel defined by slots 134, 135. The rotation of cam member 120 continues until tool pin 82 is received in slot portions 134*b*, 135*b* and abutted firmly against seating walls 143 of slots 134, 135 such that the center of pin 82 is offset from the rotative axis of cam member 120. In this locked position, the open end of the channel is displaced from tool mounting pin 82. As seen in solid lines in FIG. 7, fingers 146, 147 close off notches 116, 118 so that pin 82 cannot be released. The off-center orientation of slots 134, 135 and the infinite adjustment provided by cam member 120 enables pins 82, 83 to be tightly gripped by the seating walls of notches 101, 103, and seating walls 143 of cam member 120, irrespective of wear on the pins or tolerance differences.

Moreover, as illustrated by phantom lines in FIG. 7, tool mounting pins having a different spacing may still be coupled by device 10. When attaching to a tool with wider spaced pins, cam member 120 is merely rotated farther until seating walls 143 abut pin 82'. As seen in FIG. 7, pin 82' is locked in bulged portions 116*a*, 118*a* of rear notches 116, 118.

Release of bucket 14 would be accomplished by performing the installation steps in the reverse order. As can be appreciated, release and installation of a tool to quick coupling device 10 can be easily and quickly accomplished without even requiring the operator to leave the cab of the carrier.

The above discussion concerns the preferred embodiments of the present invention. Various other embodiments as well as many changes and alterations may be made without departing from the spirit and broader aspects of the invention as defined in the claims.

We claim:

1. A quick coupling device for attaching a tool having a pair of mounting pins to a boom of a carrier, said quick coupling device comprising:

means for attaching said quick coupling device to a boom of a carrier;

a first coupling structure including a first notch having a first seating wall, said notch being adapted to releasably receive and seat therein a first of the tool mounting pins;

a second coupling structure including a second notch adapted to receive therein a second of the tool mounting pins;

a coupling member rotatably mounted for movement about an axis between an open position and a locked position, said coupling member including a channel having a non-radial configuration with respect to said axis, said channel further having an open end and a second seating wall, in said open position of said coupling member said open end of said channel is aligned with said second notch for receiving therein the second tool mounting pin, in said locked position of said coupling member said open end of said channel is displaced from said second notch to at least substantially close said second notch and thereby retain the second tool mounting pin in said second notch, said second tool mounting pin is positioned against said second seating wall such that the center of said second tool mounting pin is offset from said axis, and said tool mounting pins are firmly gripped by said first and second seating walls, said coupling device having the capacity to effect firm gripping of pairs of tool mounting pins having different spacings therebetween.

2. A quick coupling device in accordance with claim 1 further including means for rotating said coupling member between said open and locked positions.

3. A quick coupling device in accordance with claim 2 wherein said rotating means has the capacity to rotate said coupling member to an infinite number of locked positions to accommodate differences in the spacing between tool mounting pins.

4. A quick coupling assembly in accordance with claim 2 further including means for periodically tightening said coupling member against the second tool mounting pin received in said channel.

5. A quick coupling device in accordance with claim 1 in which said coupling member includes a finger along one side of said channel, wherein said finger has a tapered free end to ensure that said finger is received around the second tool mounting pin when said coupling member is rotated to said locked position.

6. A quick coupling device for attaching a tool having a pair of mounting pins to a boom of a carrier, said quick coupling device comprising:

means for attaching said quick coupling device to a boom of a carrier;

a first coupling structure including a first notch having a first seating wall, said notch being adapted to releasably receive and seat therein a first of the tool mounting pins;

a second coupling structure including a second notch adapted to receive therein a second of the tool mounting pins;

a coupling member rotatably mounted for movement about an axis between an open position and a locked position, said coupling member including a channel having an open end and a second seating wall, said open end of said channel being aligned with said second notch when said coupling member is in said open position for receiving therein the second tool mounting pin, said open end of said channel being displaced from said second notch when said coupling member is moved to said locked position to at least substantially close said second notch and thereby retain the second tool mounting pin in said second notch, and said second seating wall being moved into engagement with the second tool mounting pin when said coupling member is rotated to said locked position so that said tool mounting pins are firmly gripped by said first and second seating walls; and means for rotating said coupling member between said open and locked positions including a cooperating worm and worm gear assembly.

7. A quick coupling device in accordance with claim 6 wherein said rotating means further includes a hydraulic motor to rotate said worm.

8. A quick coupling device for attaching a tool having a pair of mounting pins to a boom of a carrier, said quick coupling device comprising:

means for attaching said quick coupling device to a boom of a carrier;

a first coupling structure including a first notch having a first seating wall, said notch being adapted to releasably receive and seat therein a first of the tool mounting pins;

a second coupling structure including a second notch adapted to receive therein a second of the tool mounting pins; and a coupling member rotatably mounted for movement about an axis between an open position and a locked position, said coupling member including a channel having an open end and a second seating wall, said channel being shaped to have a first slot portion for receiving the second tool mounting pin and a second slot portion for locking the second tool mounting pin in said second notch, said open end of said channel being aligned with said second notch when said coupling member is in said open position for receiving therein the second tool mounting pin, said open end of said channel being displaced from said second notch when said coupling member is moved to said locked position to at least substantially close said second notch and thereby retain the second tool mounting pin in said second notch, and said second seating wall being moved into engagement with the second tool mounting pin when said coupling member is rotated to said locked position so that said tool mounting pins are firmly gripped by said first and second seating walls.

9. A quick coupling device for releasably attaching a tool having a pair of tool mounting pins to a boom of a carrier, said quick coupling device comprising:

an assembly adapted to attach said quick coupling device to a boom of a carrier;

a coupling structure including a notch having a first seating wall for receiving therein and seating a first of the tool mounting pins; and a coupling member mounted for rotation about an axis between an open position and a locked position, said coupling member including a channel having an open end and a second seating wall, said channel at least adjacent said second seating wall having a non-radial configuration with respect to said axis, in said open position said coupling member is adapted to receive a second of the tool mounting pins in said open end of said channel, in said locked position said open end of said channel is displaced from said second tool mounting pin, said second tool mounting pin is engaged against said second seating wall such that the center of the second tool mounting pin is offset from said axis, and said tool mounting pins are firmly engaged and locked by said first and second seating walls, said coupling device having the capacity to effect firm gripping of pairs of tool mounting pins having different spacings therebetween.

10. A quick coupling device in accordance with claim 9 further including a second coupling structure having a second notch, said second notch being open concurrently with an open end in said channel when said coupling member is in said open position so that the second tool mounting pin is received concurrently in said channel and said second notch, and said second notch being closed by said coupling member when said coupling member is rotated to said locked position to thereby retain the second tool mounting pin in said second notch.

11. A quick coupling device in accordance with claim 9 further including a drive assembly for rotating said coupling member between said open and locked positions.

12. A quick coupling device in accordance with claim 11 wherein said drive assembly has the capacity to rotate said coupling member to an infinite number of locked positions to accommodate differences in the spacing between tool mounting pins.

13. A quick coupling assembly in accordance with claim 11 further including means for periodically tightening said coupling member against the second tool mounting pin received in said channel.

14. A quick coupling device in accordance with claim 9 in which said channel in said coupling member is shaped to have a first slot portion for receiving the second tool mounting pin and a second slot portion for locking the second tool mounting pin in said channel.

15. A quick coupling device in accordance with claim 9 in which said coupling member includes a finger along one side of said channel, wherein said finger has a tapered free end to ensure that said finger is received around the second tool mounting pin to retain the second tool mounting pin in said channel when said coupling member is rotated to said locked position.

16. A quick coupling device for releasably attaching a tool having a pair of tool mounting pins to a boom of a carrier, said quick coupling device comprising:

an assembly adapted to attach said quick coupling device to a boom of a carrier;

a coupling structure including a notch having a first seating wall for receiving therein and seating a first of the tool mounting pins;

a coupling member mounted for rotation about an axis between an open position and a locked position, said coupling member including a channel defining a non-radial path and including a second seating wall, said coupling member being adapted to receive a second of the tool mounting pins in said channel when in said open position, said coupling member being rotatable to said locked position until said second tool mounting pin travels along said path defined by said channel and engages said second seating wall whereby said tool mounting pins are firmly engaged and locked by said first and second seating walls; and a drive assembly for rotating said coupling member between said open and locked positions, said drive assembly including a cooperating worm and worm gear assembly.

17. A quick coupling device in accordance with claim 16 wherein said drive assembly further includes a motor to rotate said worm.

18. A quick coupling device for attaching a tool having a pair of tool mounting pins to a boom of a carrier, said quick coupling device comprising:

a base plate having a first side and a second side;

a plurality of mounting flanges fixedly attached to said first side of said base plate, said mounting flanges extending outward from said base plate in a first direction, each said mounting flange including a plurality of bores for pivotally connecting said flanges to a boom of a carrier;

a plurality of coupling flanges fixedly attached to said second side of said base plate, said coupling flanges extending outward from said base plate in a second direction opposite to said first direction, each said coupling flange including a first notch and a second notch, said first and second notches being adapted to receive therein first and second tool mounting pins;

a cam member mounted along said second side of said base plate between said coupling flanges and adjacent said second notches, said cam member including a channel having an open end and a seating wall, said cam member being rotatable about an axis between an open position and a locked position, said channel having a non-radial configuration with respect to said axis, in said open position of said cam member said open end of said channel is aligned with said second notches for concurrently receiving the second tool mounting pin in said second notches and said channel, in said locked position of said cam member said open end of said channel is displaced from the second tool mounting pin, the second tool mounting pin is engaged against said seating wall such that the center of the second mounting pin is offset from said axis, and the tool mounting pins are firmly gripped by said seating wall and said first notches, said coupling device having the capacity to effect firm gripping of pairs of tool mounting pins having different spacings therebetween; and an assembly for rotating said cam member about said axis.

19. A quick coupling device in accordance with claim 18 wherein said rotating assembly has the capacity to rotate said cam member to an infinite number of locked positions to accommodate differences in the spacing between tool mounting pins.

20. A quick coupling assembly in accordance with claim 18 further including means for periodically tightening said cam member against the second tool mounting pin received in said channel.

21. A quick coupling device in accordance with claim 18 in which said cam member includes a finger along one side of said channel which wraps around the second tool mounting pin in said locked position to close the second tool mounting pin in said second notches.

22. A quick coupling device for attaching a tool having a pair of tool mounting pins to a boom of a carrier, said quick coupling device comprising:

a base plate having a first side and a second side;

a plurality of mounting flanges fixedly attached to said first side of said base plate, said mounting flanges extending outward from said base plate in a first direction, each said mounting flange including a plurality of bores for pivotally connecting said flanges to a boom of a carrier;

a plurality of coupling flanges fixedly attached to said second side of said base plate, said coupling flanges extending outward from said base plate in a second direction opposite to said first direction, each said coupling flange including a first notch and a second notch, said first and second notches being adapted to receive therein first and second tool mounting pins;

a cam member mounted along said second side of said base plate between said coupling flanges and adjacent said second notches, said cam member including a channel having an open end and a seating wall, said cam member being rotatable about an axis between an open and a locked position, said open end of said channel being aligned with said second notches for concurrently receiving the second tool mounting pin in said second notches and said channel, said cam member being rotated to said locked position to engage said seating wall against the second mounting pin to firmly grip the tool mounting pins by said seating wall and said first notches; and an assembly for rotating said cam member about said axis including a worm and a worm gear.

23. A quick coupling device in accordance with claim 22 wherein said rotating assembly further includes a hydraulic motor to rotate said worm.

24. A quick coupling device for attaching a tool having a pair of tool mounting pins to a boom of a carrier, said quick coupling device comprising:

a base plate having a first side and a second side;

a plurality of mounting flanges fixedly attached to said first side of said base plate, said mounting flanges extending outward from said base plate in a first direction, each said mounting flange including a plurality of bores for pivotally connecting said flanges to a boom of a carrier;

a plurality of coupling flanges fixedly attached to said second side of said base plate, said coupling flanges extending outward from said base plate in a second direction opposite to said first direction, each said coupling flange including a first notch and a second notch, said first and second notches being adapted to receive therein first and second tool mounting pins;

a cam member mounted along said second side of said base plate between said coupling flanges and adjacent said second notches, said cam member including a channel having an open end and a seating wall, said channel being shaped to have a first slot portion for receiving the second tool mounting pin and a second slot portion for locking the second tool mounting pin in said second notches, said cam member being rotatable about an axis between an open and a locked position, said open end of said channel being aligned with said second notches for concurrently receiving the second tool mounting pin in said second notches and said channel, said cam member being rotated to said locked position to engage said seating wall against the second mounting pin to firmly grip the tool mounting pins by said seating wall and said first notches; and an assembly for rotating said cam member about said axis.

* * * * *